US006164438A

United States Patent [19]

VerMehren

[11] Patent Number: 6,164,438

[45] Date of Patent: Dec. 26, 2000

[54] ADJUSTABLE CONTROL ROLLER APPARATUS AND METHOD

[76] Inventor: H. Richard VerMehren, 3865 N. Palafox St., Pensacola, Fla. 32505

[21] Appl. No.: 09/094,178

[22] Filed: Jun. 9, 1998

Related U.S. Application Data

[63] Continuation-in-part of application No. 08/700,818, Aug. 21, 1996.

[51] Int. Cl.[7] ..... B65G 15/00

[52] U.S. Cl. ..... 198/836.3; 271/272

[58] Field of Search ..... 198/836.1, 836.3, 198/837; 271/272, 274

[56] References Cited

U.S. PATENT DOCUMENTS

| | | | |
|---|---|---|---|
| 1,986,857 | 1/1935 | Roberts et al. . | |
| 2,757,928 | 8/1956 | Thomas | 271/272 |
| 3,118,663 | 1/1964 | Logan | 271/272 |
| 3,153,964 | 10/1964 | Cordey | 198/626.5 |
| 3,392,637 | 7/1968 | Back | 271/272 |
| 4,225,035 | 9/1980 | Mohney et al. | 198/836.3 |
| 5,090,672 | 2/1992 | Ballestrazzi et al. | 270/45 |
| 5,279,095 | 1/1994 | Muller | 198/626.5 |
| 5,456,457 | 10/1995 | Kerstein et al. | 271/272 |
| 5,947,470 | 9/1999 | Fernandez | 271/272 |

FOREIGN PATENT DOCUMENTS

| | | | |
|---|---|---|---|
| 1182136 | 2/1985 | Canada | 271/272 |
| 910311 | 6/1946 | France | 271/272 |

*Primary Examiner*—Joseph E. Valenza
*Assistant Examiner*—Joe Dillon, Jr.
*Attorney, Agent, or Firm*—Thomas, Kayden, Horstemeyer & Risley

[57] ABSTRACT

An adjustable control roller apparatus for use in a belt-type conveyor assembly comprises a upright support arm having a pivot pin and a first attachment member, and a pivot member engaging the pivot pin. The pivot member has a second attachment member and a pair of rollers rotatably mounted thereon. A biasing member engages the first and second attachment members for biasing the rollers of the pivot member toward the lower conveyor belt of a second section of the conveyor assembly. A support bracket is also included for adjustably supporting the upright support arm so that the rollers can be positioned between the exit pulleys of a first conveyor section and the entrance pulleys of the second conveyor section of the conveyor assembly.

10 Claims, 6 Drawing Sheets

ADJUSTABLE CONTROL ROLLER APPARATUS AND METHOD

RELATED APPLICATIONS

This application is a Continuation-In-Part application based on and claiming priority to U.S. patent application Ser. No. 08/700,818, filed on Aug. 21, 1996, which is herein incorporated by reference.

FIELD OF THE INVENTION

The present invention relates to belt-type conveyor systems. More specifically, the present invention relates to a device for controlling the movement of work pieces, such as envelopes, as the work pieces are transferred between two conveyor sections which are transporting the work pieces at different speeds.

DESCRIPTION OF THE PRIOR ART

Dual-belt conveyors which are used for transporting envelopes or other similar sized and shaped work pieces in series along a processing path through a series of work stations, usually with the leading edges of the work pieces oriented at a right angle with respect to the processing path, typically incorporate several separate and aligned conveyor sections. Each dual-belt conveyor section typically incorporates a lower conveyor belt assembly having a drive pulley, an idler pulley and a continuous transport belt extending around the pulleys, and an upper conveyor belt assembly having an upper transport belt and pulley arrangement. The two transport belts move together into overlying relationships and grasp a work piece and carry the work piece along the processing path. Each conveyor section is specifically designed to transport the work pieces in sequence through a particular process, such as a printing process, folding process, gluing process, etc., with each process having a specific linear speed and length.

When work pieces, such as envelopes, are being processed by conveyor sections which provide, for example, for sequential gluing, drying and folding of the work pieces, the work pieces are conveyed in sequence from one conveyor section to the next conveyor section with the sections typically operating at different speeds. In particular, once glue has been applied to the work pieces during the gluing process, the work pieces usually are transferred from the gluing conveyor to a drying conveyor which advances the work pieces at a slower velocity than the gluing conveyor along a path adjacent heat lamps which dry the glue. When transferring the work pieces between the gluing and drying conveyor sections, it is difficult to control the attitude of the work pieces because control of the work pieces is given up by the transport belts of the gluing conveyor and is acquired by the transport belts of the drying conveyor, creating a tendency for the work pieces to become disoriented or skewed out of alignment in the subsequent drying conveyor, thus sometimes foiling the function of the subsequent drying conveyor.

For example, a high speed off-line gluing machine, such as a Cheetah® brand gluing machine produced by VerMehren Engineering of Pensacola, Fla., is primarily used by the paper product manufacturing and the commercial printing industries for the processing of paper products, and particularly, for the production of envelopes. The Cheetah brand machine is a dual-belt-type conveyor assembly having sections driven by motors with one motor driving the conveyor of a gluing section and the other motor driving the conveyor of a dryer/delivery section. The motors typically operate the transport belts of the conveyors at different surface speeds, with the work pieces, e.g. envelopes, travelling faster through the gluing section of the machine than through the subsequent dryer/delivery section of the machine.

The gluing section of the Cheetah machine receives envelopes from a conventional feeder conveyor and incorporates 6" diameter (18.85" circumference) pulleys which provide a nominal spacing of 18.85" between the trailing edges of adjacent envelopes regardless of the width of the envelope traveling through the gluing section. However, the trailing edges of adjacent envelopes are not required to be spaced 18.85" apart when the envelopes are traveling through the dryer/delivery section. In the dryer/delivery section, the envelopes can be spaced so that the distance between the trailing edge of a first envelope and the leading edge of the envelope immediately behind the first envelope is between 1" to 1½". Running the envelopes through the dryer/delivery section spaced at 1" to 1½" intervals allows the machine to increase production substantially since more envelopes will occupy the dryer/delivery section.

Because the speed of the gluing section is greater than the speed of the subsequent dryer/delivery section, a space is provided between the gluing section and the dryer/delivery section so that envelopes can smoothly transition from the higher transport speed of the gluing section to the slower transport speed of the subsequent dryer/delivery section. This space includes a vertical gap and a longitudinal gap which are provided at the entrance of the dryer/delivery section. The vertical gap is formed by separating upper and lower dryer belt entrance pulleys of the dryer/delivery section at the entrance end of the dryer/delivery section so that the entrance opening between the transport belts is larger than the size which is required to engage and grasp an entering envelope. If this vertical gap between the receiving transport belts is too small, an envelope could engage both the upper and lower belts of the dryer/delivery section before being disengaged by the transport belts of the gluing section. Since the belts of the dryer/delivery section move at a slower surface velocity than the surface velocity of the belts of the gluing section, engaging both the belts of the gluing section and the belts of the dryer/delivery section simultaneously could either cause the envelope to buckle or bend, or cause the belts of the dryer/delivery section to jam or otherwise malfunction. However, if the gap is too large, the envelopes are not physically controlled as they move through the oversized gap, which tends to produce the unwanted effect of allowing the envelopes to twist or skew slightly because the envelopes are not held in proper alignment with the conveyor belts of either conveyor section for an optimum duration.

The skewing of envelopes which occurs during transfer of the envelopes between the gluing section and the dryer/delivery section is due primarily to the physical characteristics of the envelopes. Each envelope moves along the processing path with its top and bottom edges extending parallel to the processing path and its opposed side edges are the leading and trailing edges extending at a right angle with respect to the path. The bottom edge of an envelope typically enters the dryer/delivery section with a folded and glued flap, e.g. three plies of material thick at its intersection with its side edges, which is thicker than the top edge of the envelope which enters the dryer/delivery section without a folded and glued flap, e.g. two plies thick at its intersection with its side edges. This difference in thickness tends to cause the thicker bottom edge of the envelope to contact the upper and lower transport belts of the dryer/delivery section at the nip of the converging belts before the thinner top edge of the envelope contacts the belts. This causes the bottom edge of the envelope to slow down to the speed of the dryer/delivery belts prior to the top edge of the envelope slowing to the same speed, thereby causing the envelope to twist or skew relative to the dryer/delivery belts with the bottom edge lagging the top edge.

To prevent the skewing of envelopes during transfer from the gluing section to the dryer/delivery section it has heretofore been desirable to reduce the longitudinal gap through which an envelope travels between the conveyor sections so that the envelopes have a shorter uncontrolled distance to travel during transfer. However, there is a practical limitation to this solution because of the relationship of the conveyor sections. A sufficient longitudinal gap must be maintained between the belts of the gluing section and the belts of the dryer/delivery section to prevent the belts from contacting each other and jamming. Additionally, since the upper and lower belts overlie and slide relative to each other, there must be a sufficient vertical gap maintained between the upper and lower dryer/delivery entrance pulleys to accommodate belt slippage. Maintaining an optimal vertical gap between the entrance pulleys in order to minimize the opportunity for envelope skewing while maintaining an optimal longitudinal gap in order to accommodate belt slippage requires accurate adjustment of the position of the entrance pulleys which can result in skewing of envelopes or binding and misalignment of the upper and lower dryer/delivery belts if the adjustment process is not properly performed and maintained.

Therefore, it is desirable to provide a device which is capable of providing uniformly accurate placement of envelopes and other varied thickness work pieces into the transport belts of a dual belt conveyor as the work pieces are transferred from one dual belt conveyor to another dual belt conveyor and which does not require continuously adjusting the spacing of the conveyor entrance pulleys.

SUMMARY OF THE INVENTION

Briefly described, the present invention comprises an improved apparatus and method for providing uniformly accurate placement of work pieces, such as envelopes and other folded paper products, along a conveyor assembly as the work pieces are transferred from one dual belt conveyor to another dual belt conveyor. The apparatus includes an adjustable roller assembly which is positioned between conveyor sections of a conveyor assembly, such as between the gluing section and the subsequent dryer/delivery section of a Cheetah brand gluing machine, among others.

The apparatus incorporates a support bracket having an elongated slot for allowing horizontal adjustment of the position of a roller assembly which is biased to engage an extended portion of a lower belt of the dryer/delivery section. The apparatus is mounted to a side frame of the conveyor assembly, so that the rollers of the roller assembly engage the leading edge of an envelope almost immediately after the trailing edge of the envelope departs the exit pulleys of the gluing section. In this manner, the adjustable control rollers retain the envelope against the lower dryer belt, thereby maintaining the alignment of the envelope as it is transferred to the dryer/delivery section of the machine.

In order to facilitate mounting of the apparatus to a Cheetah brand gluing machine, the upper entrance pulley of the dryer/delivery section and its upper belt, which are typically positioned directly above the lower entrance pulley and its lower belt, are repositioned rearwardly along the processing path so that the lower belt protrudes out from beneath the upper belt and forms a moving envelope receiving area for the transferring envelopes, and the roller assembly is positioned above and biased downwardly against the lower belt in the receiving area to engage the lower dryer belt in the vicinity of the lower entrance pulley between the exit pulley of the gluing section and the upper entrance pulley of the dryer/delivery section. Additionally, the upper entrance pulley can be lowered toward the lower dryer belt so that the prior art vertical gap between the upper and lower dryer belts is reduced.

Once properly positioned, a biasing member, such as a spring, elastic band, weight, etc., is selected, based on the operating speeds of the conveyor sections and the physical characteristics of the envelopes, such as weight, thickness, etc., and attached to the roller assembly to provide the downward biasing force for promoting engagement of the roller assembly with the lower dryer/delivery belt and the work pieces moving with the belt. So configured, the rollers engage the leading edge of each envelope between its varied thickness top and bottom edges shortly after the trailing edge of each envelope departs the conveyor belts of the gluing section.

The rollers are of a smaller lateral dimension than the dimension of the envelopes extending across the conveyors so that the rollers engage only the uniform thickness middle section of each envelope, without engaging either the thicker three layer bottom portion of the envelope or the thinner single layer of the flap of the envelope, so there is no tendency of the rollers to change the attitude of the envelopes. In this manner, envelopes transferring from the gluing section to the subsequent dryer/delivery section are substantially maintained in proper alignment relative the belts of the dryer/delivery section because the rollers cause the envelopes to be held in engagement with and match the surface velocity of the lower belt of the dryer/delivery section after the envelopes depart the belts of the gluing section and prior to their engaging the upper belt of the dryer/delivery section.

Therefore, it is an object of the present invention to provide an adjustable control roller assembly which is capable of providing uniformly accurate placement of work pieces along a conveyor belt as the work pieces are transferred from one conveyor section to another slower moving conveyor section.

Another object of the present invention to provide an improved dual-belt conveyor system for advancing envelopes and other substantially flat work pieces and for transferring the work pieces between dual-belt conveyor sections operating at different speeds.

It is another object of the present invention to provide an adjustable control roller assembly which is capable of providing uniformly accurate placement of work pieces along a receiving conveyor belt of a dual belt conveyor as the work pieces are transferred from one conveyor section to another conveyor section when the conveyor sections are operating at different speeds.

It is another object of the present invention to provide an adjustable control roller assembly which is capable of providing uniformly accurate placement of work pieces along a conveyor belt as the work pieces are transferred from one dual belt conveyor to another dual belt conveyor and which is capable of adjusting to accommodate work pieces of various sizes and shapes.

It is yet another object of the present invention to provide an improved method for providing uniformly accurate placement of work pieces along a conveyor belt as the work pieces are transferred from one conveyor section to another conveyor section.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present invention and together with the description serve to explain the principles of the invention. The components in the drawings are not necessarily to scale, emphasis instead being placed upon clearly illustrating principles of the present invention.

DETAILED DESCRIPTION OF THE PREFERRED EMBODIMENTS

Figure 1:
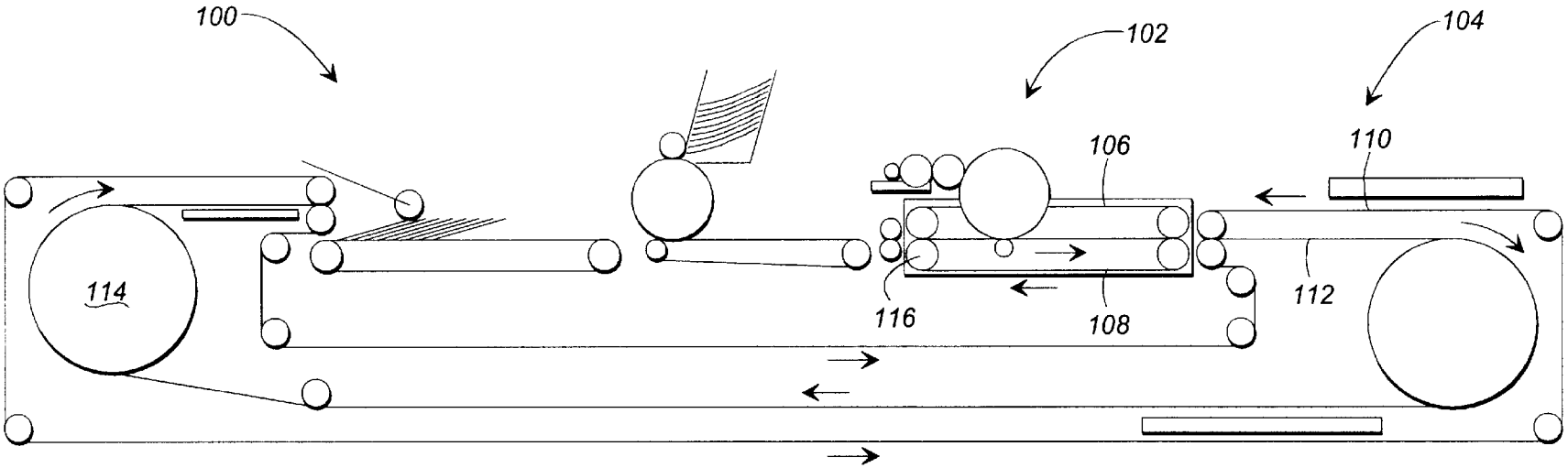
FIG. 1 (PRIOR ART)
FIG. 1 illustrates a schematic view of a prior art Cheetah brand envelope gluing machine.

Reference will now be made in detail to the description of the present invention as illustrated in the drawings with like numerals indicating like parts throughout the several views.

As shown in FIG. 1, a conveyor assembly 100, such as a high speed off-line gluing machine, e.g. VerMehren Engineering's Cheetah brand machine, has a first conveyor section 102, e.g. a gluing section, and a second conveyor section 104, e.g. a dryer/delivery section. Conveyor section 102 is a dual-belt conveyor having an upper transfer belt 106 and a lower transfer belt 108, which engage each other in an overlying relationship. Likewise, conveyor section 104 is a dual-belt conveyor having an upper dryer belt 110 and a lower dryer belt 112, which also engage each other in an overlying relationship.

The conveyor sections 102 and 104 each have a drive pulley, 114 and 116 respectively, with drive pulleys 114 and 116 each driven by a motor (not shown), such that conveyor section 102 is driven at a faster surface velocity than conveyor section 104. Thus configured, the drive pulleys 114 and 116 engage the lower belts 108 and 112, causing the lower belts to advance, thereby causing the upper belts 106 and 110 to advance due to the frictional engagement between the upper and lower sets of belts. Therefore, when a work piece (not shown) is placed between a set of upper and lower belts, the work piece will be advanced along with the belts due to the frictional engagement between the belts and the work piece.

Figure 2:
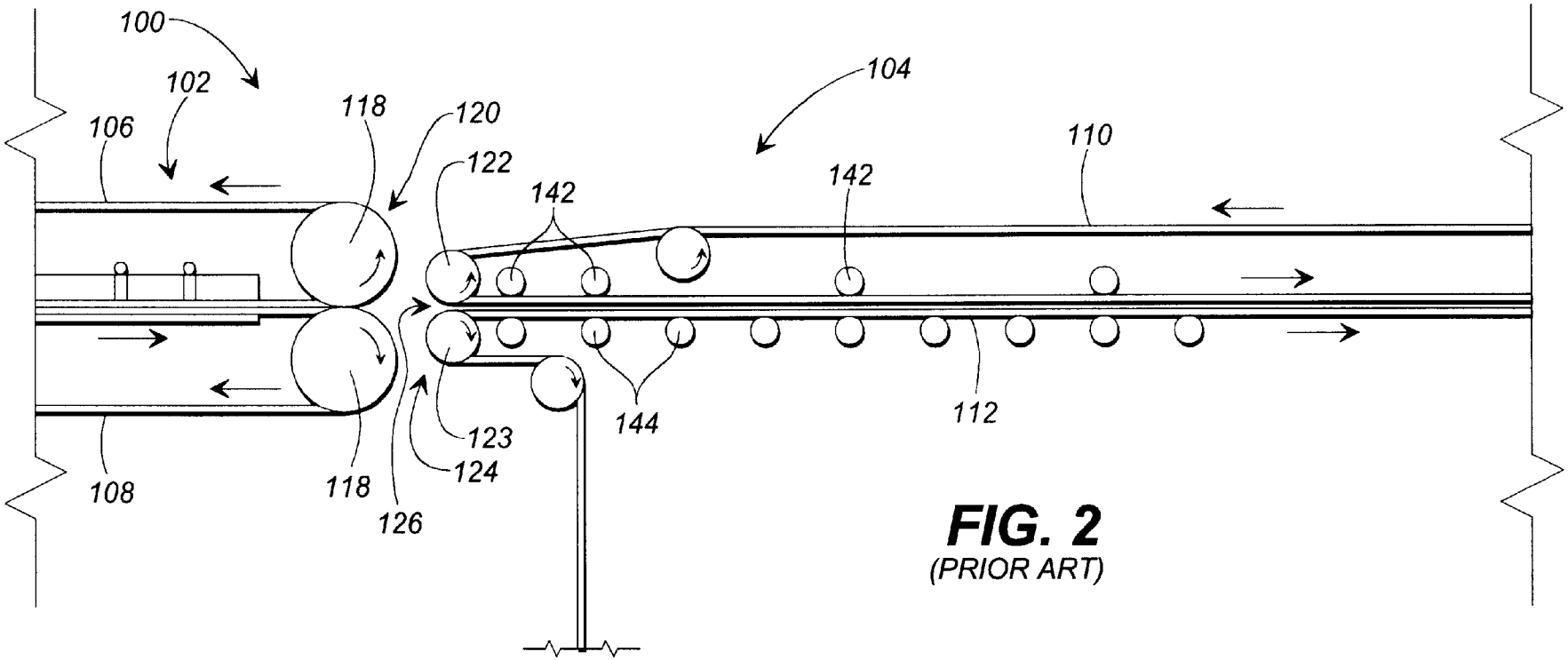
FIG. 2 (PRIOR ART)
FIG. 2 illustrates a detailed schematic view of the transfer area between the gluing section and the dryer/delivery section of the envelope gluing machine of FIG. 1.

As shown in FIG. 2, first conveyor section 102 incorporates a pair of exit pulleys 118 arranged in an overlying relationship with each other at the delivery end 120 of the section 102. Additionally, second conveyor section 104 incorporates upper and lower entrance pulleys 122 and 123 arranged in an overlying relationship with each other at the entrance end 124 of the section 104. A vertical gap 126 is formed between the entrance pulleys 122 and 123 so that the upper and lower dryer belts 110 and 112 do not engage each other at the entrance end 124.

This gapped-arrangement of the entrance pulleys 122 and 123 shown in FIG. 2 illustrates a prior art configuration for accommodating the transfer of a work piece from section 102 to 104, whereby the gap 126 allows a work piece to decelerate from the transport speed of the faster moving section 102 to the transport speed of the slower moving section 104 without allowing the work piece, e.g. an envelope, to bend or buckle, as could occur if the entrance pulleys 122 and 123 were arranged in an ungapped-arrangement (not shown). In the ungapped-arrangement, the leading edge of a work piece to would be engaged, and therefore, slowed between the entrance pulleys 122 and 123 while the exit pulleys 118 were ejecting the trailing edge of the work piece. The difference in speed between the leading and trailing edges of the work piece produced by the differing speeds of the exit and entrance pulleys could cause the work piece to bend or buckle, or also could cause the conveyor assembly 100 to jam or otherwise malfunction.

Figure 3:
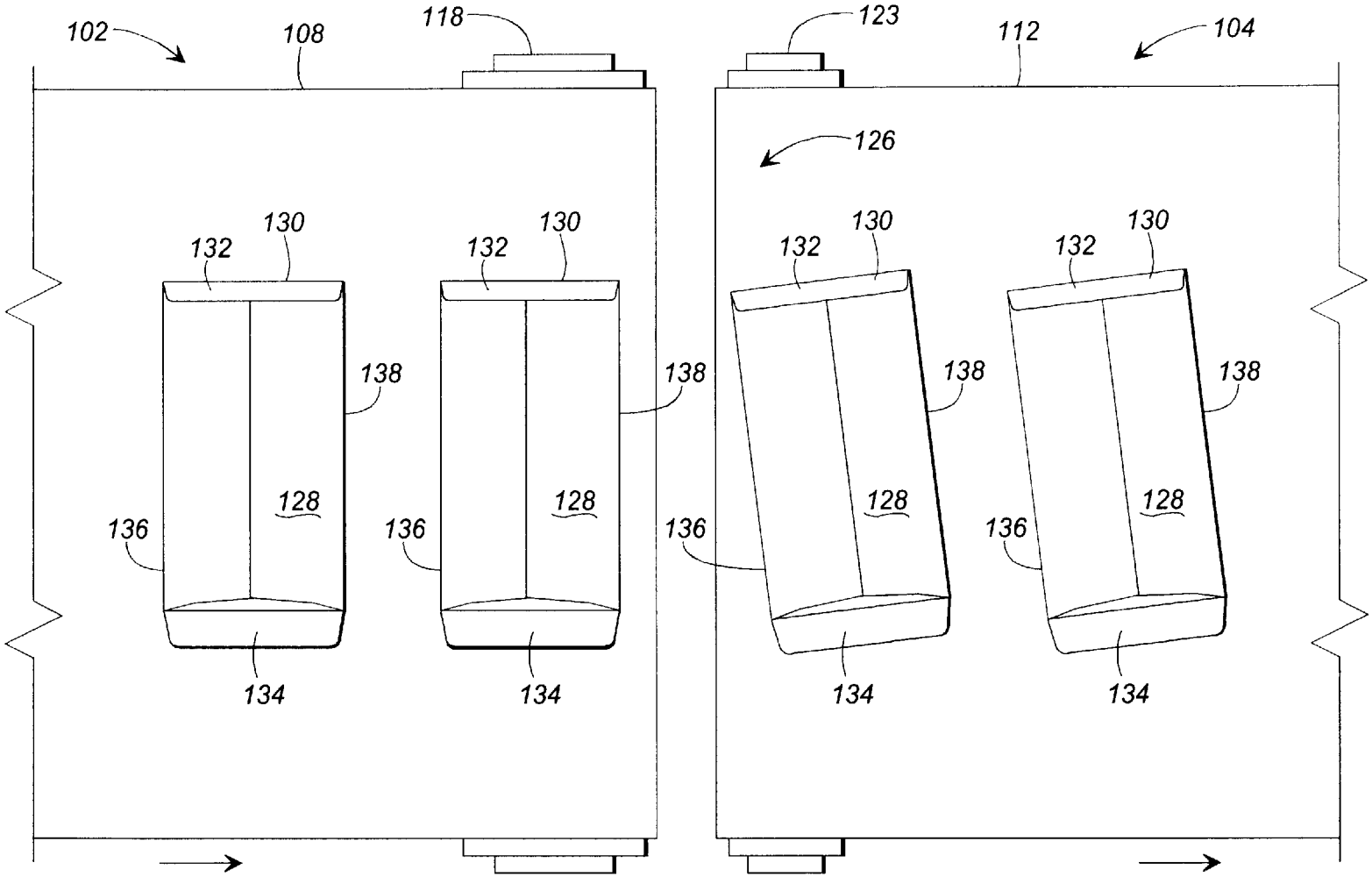
FIG. 3 (PRIOR ART)
FIG. 3 illustrates a top view of representative envelopes being transported through the transfer area of FIG. 2 with the upper exit pulley, upper dryer belts and support frame not shown for clarity of description.

As shown in FIG. 3, however, the gap 126 can cause work pieces, shown as envelopes 128, to twist or skew relative to the upper and lower dryer belts, 110 and 112, because the envelopes 128 are not held in proper alignment with the belts as the envelopes 128 depart the exit pulleys 118 and enter the gap 126 between the entrance pulleys 122 and 123. Improper alignment of the envelopes 128 is caused during transfer from the faster section 102 to the slower section 104 due to the physical characteristics of the envelopes 128. In particular, the bottom end 130 of the envelope enters the gap 126 of section 104 with a folded and glued flap 132 which is thicker, e.g. four plies of material thick at its center, than the top end 134 of the envelope which enters the gap 126 without a folded and glued flap 132, e.g. three plies thick at its center. This difference in thickness causes the bottom end 130 of the envelope to initially contact, and therefore, create more friction with the upper and lower belts, 110 and 112, than the top end 134 of the envelope. This causes the bottom end 130 of the envelope to slow down to the speed of the belts 110 and 112 prior to the top end 134 of the envelope slowing down to the speed of the belts 110 and 112, thereby causing the envelope 128 to twist or skew relative to the belts 110 and 112. This skewing also can have the unwanted result of creating non-uniform spacing between the trailing edges 136 of the envelopes 128 and the subsequent leading edges 138 of the next envelope 128 to be processed.

Figure 4:
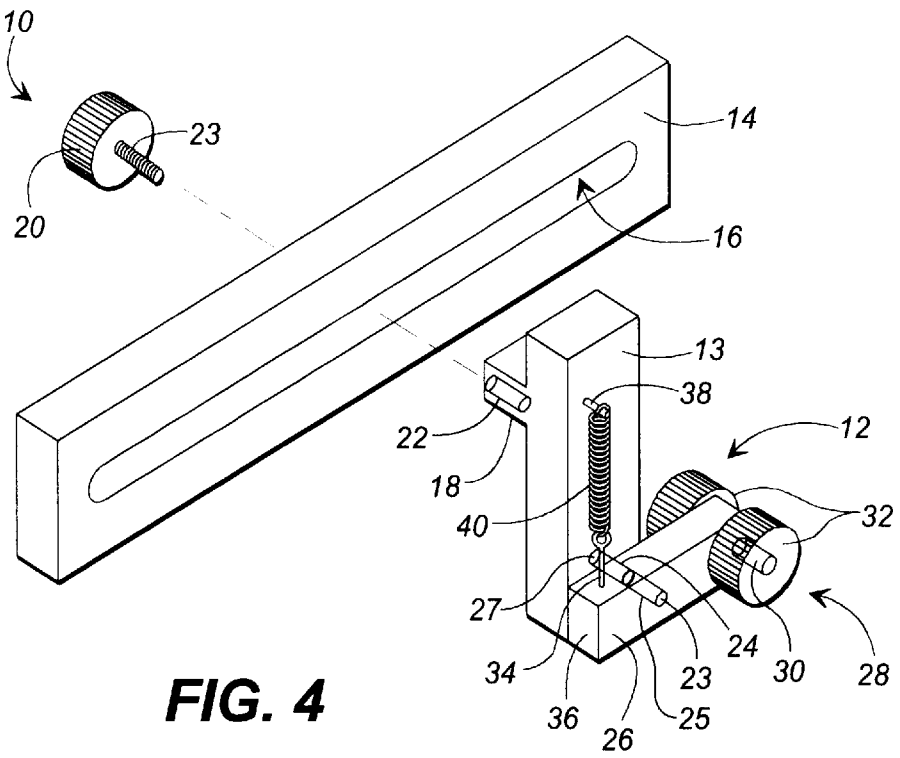
FIG. 4 illustrates a partially exploded perspective view of the preferred embodiment of the present invention.

As shown in FIG. 4, the preferred embodiment of the adjustable control roller apparatus 10 of the present invention substantially controls the transfer of envelopes 128 between multiple conveyor sections of a conveyor assembly, particularly those sections operating at different speeds, such as between conveyor sections 102 and 104 of conveyor assembly 100 described herein above.

The apparatus 10 includes a work piece position control assembly 12 and a support bracket 14 which functions as a support member for supporting the control assembly 12. Support bracket 14 includes an elongated horizontal support slot 16 which receives and supports the control assembly 12 and allows the control assembly 12 to be adjustably positioned longitudinally relative to the support bracket 14. The control assembly 12 has a upright support arm 13 incorporating a laterally extending protrusion 18 that functions as a key member for insertion through the elongated slot 16 and an adjustable threaded screw lock 20 for threadedly engaging the protrusion 18 on the other side of the support bracket 14 from the control assembly 12 such that the screw lock 20 secures the protrusion 18 to the support bracket 14. In a preferred embodiment (FIG. 4), the protrusion 18 has an internally threaded bore 22 for receiving the threaded screw 23 of the to screw lock 20 for securing the protrusion 18 to the support bracket 14.

A longitudinally extending articulated roller support leg 26 which functions as a pivot member is pivotally mounted to the upright support arm 13 by a laterally extending pivot pin 23. The pivot pin extends through a bore 25 of roller support leg 26 and bore 27 of upright support arm 13. The upright support arm 13 also has a pivot pin 24 for pivotally engaging a support leg 26 of the control assembly 12 which resides within a bore 27. Support leg 26 incorporates a roller assembly 28 having an axle 30 extending through the distal end of support leg 26 and a pair of rollers 32 mounted to the ends of axle 30 and straddling the support leg 26. The rollers 32 also can incorporate bearing assemblies (not shown) to further facilitate rotation of the rollers 32.

As shown in FIG. 4, biasing of the roller assembly 28 is accomplished by connecting a support leg attachment member 34, preferably in the form of an upwardly extending eye-hook, to the proximal end 36 of the support leg 26 and connecting a support arm attachment member 38, preferably in the form of a laterally extending pin, to the upright support arm 13 and suspending a coil tension spring between the eye hook and pin. The spring, therefore, functions as a biasing member 40 for urging the rollers 32 in a downward arc. So configured, a biasing member 40 possessing an appropriate biasing force can be mounted to attachment members 34 and 38, thereby biasing the proximal end 36 of the roller support leg upwardly so that the roller assembly 28 at the distal end of the roller support leg is biased downwardly for engaging work pieces.

Figure 5:
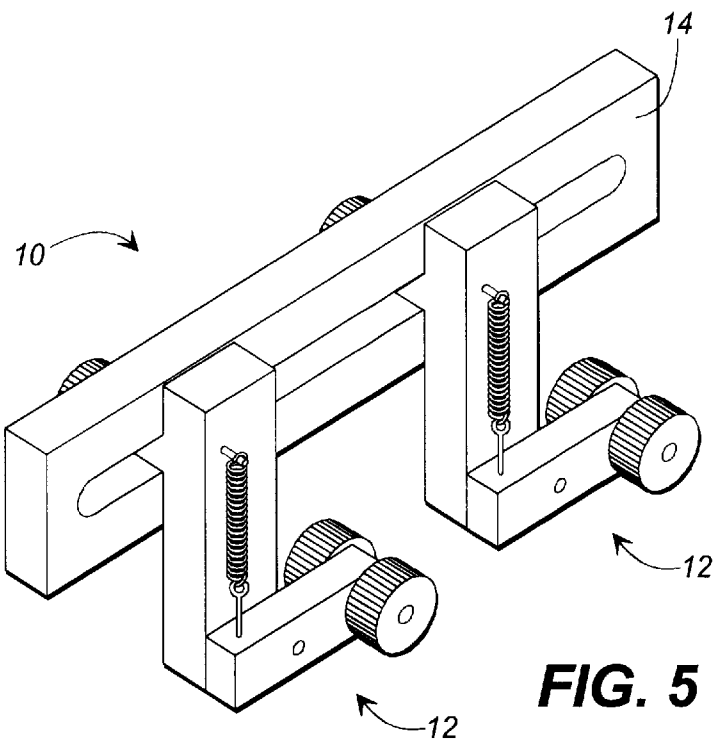
FIG. 5 illustrates a partially exploded perspective view of an alternative embodiment of the present invention.

In an alternative embodiment of the present invention (FIG. 5), support bracket 14 can incorporate multiple control assemblies 12 which can be independently positioned along the slot 16 of the support bracket 14 for maintaining the alignment of work pieces. Additionally, the roller assembly 28 also can be configured with a single roller 32 (not shown), instead of the paired-roller arrangement shown in the preferred embodiment of FIG. 4.

Figure 6:
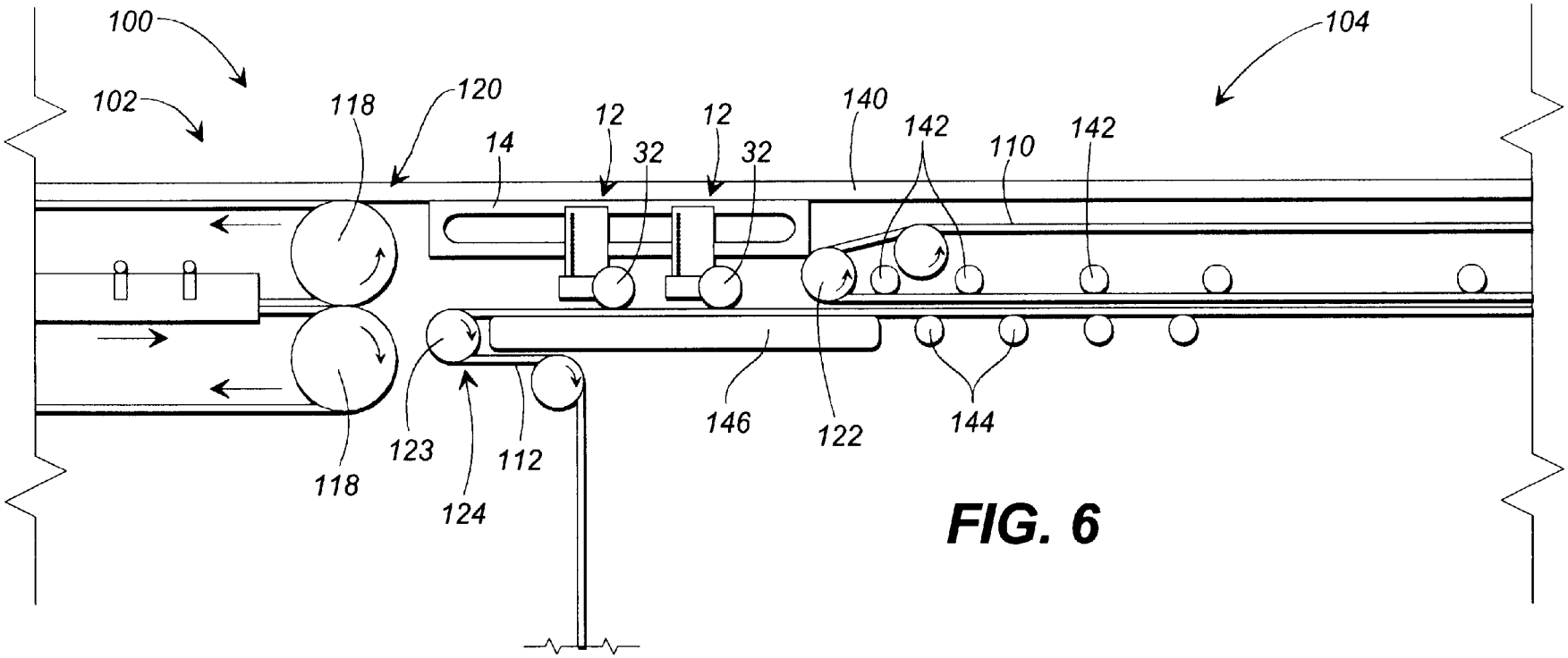
FIG. 6 illustrates a detailed schematic view showing detail of the transfer area between the gluing section and the dryer/delivery section of a Cheetah brand envelope gluing machine incorporating the present invention.

As shown in FIG. 6, the adjustable control roller apparatus 10 of the present invention is capable of being installed intermediate two conveyor sections, such as between the sections 102 and 104 of a Cheetah brand high-speed gluing machine illustrated in FIG. 1. The adjustable control roller apparatus 10 can be mounted in a conventional manner, i.e. clamping, fastening, welding, etc., to portion of a support frame 140 of the conveyor assembly 100 which is at least partially disposed between the exit pulleys 118 of the gluing machine and the entrance pulley 122 of the dryer/delivery machine. In order to mount the apparatus 10 in this location, the existing entrance pulley 122 which engages the upper dryer belt 110 and some of the existing upper dryer belt pressure rollers 142 should be removed and/or relocated (see FIGS. 1 and 2). However, the existing entrance pulley 122 engaging the lower dryer belt 112 should remain in its existing location.

The roller assembly 28 therefore acts as a biasing means for urging the work pieces into frictional engagement with the transport belt, requiring the work pieces to assume the velocity of the lower transport belt. Other types of biasing means can be used as may be suitable for the system if desired, such as air jets, a band conveyor, a leaf spring, etc.

Additionally (as shown by comparing FIGS. 2 and 6), some of the lower dryer belt rollers 144 also can be removed and replaced with a table or shelf 146 which engages the bottom surface of the lower dryer belt 112 in the vicinity of the apparatus 10, thereby minimizing the up and down travel of the belt 112 which typically occurs as the belt travels over the spaced series of belt rollers 144. In this manner, the roller assembly 28 can maintain a more uniform engagement with the upper surface of the lower dryer belt 112.

When properly positioned and adjusted, the apparatus 10 substantially prevents uneven delivery of envelopes 128 from the higher speed section 102 to the slower speed section 104. It should be noted, however, that the apparatus 10 and method of the present invention is suitable for use in other conveyor arrangements and with work pieces other than envelopes.

Method of Installation and Operation

Figure 7:
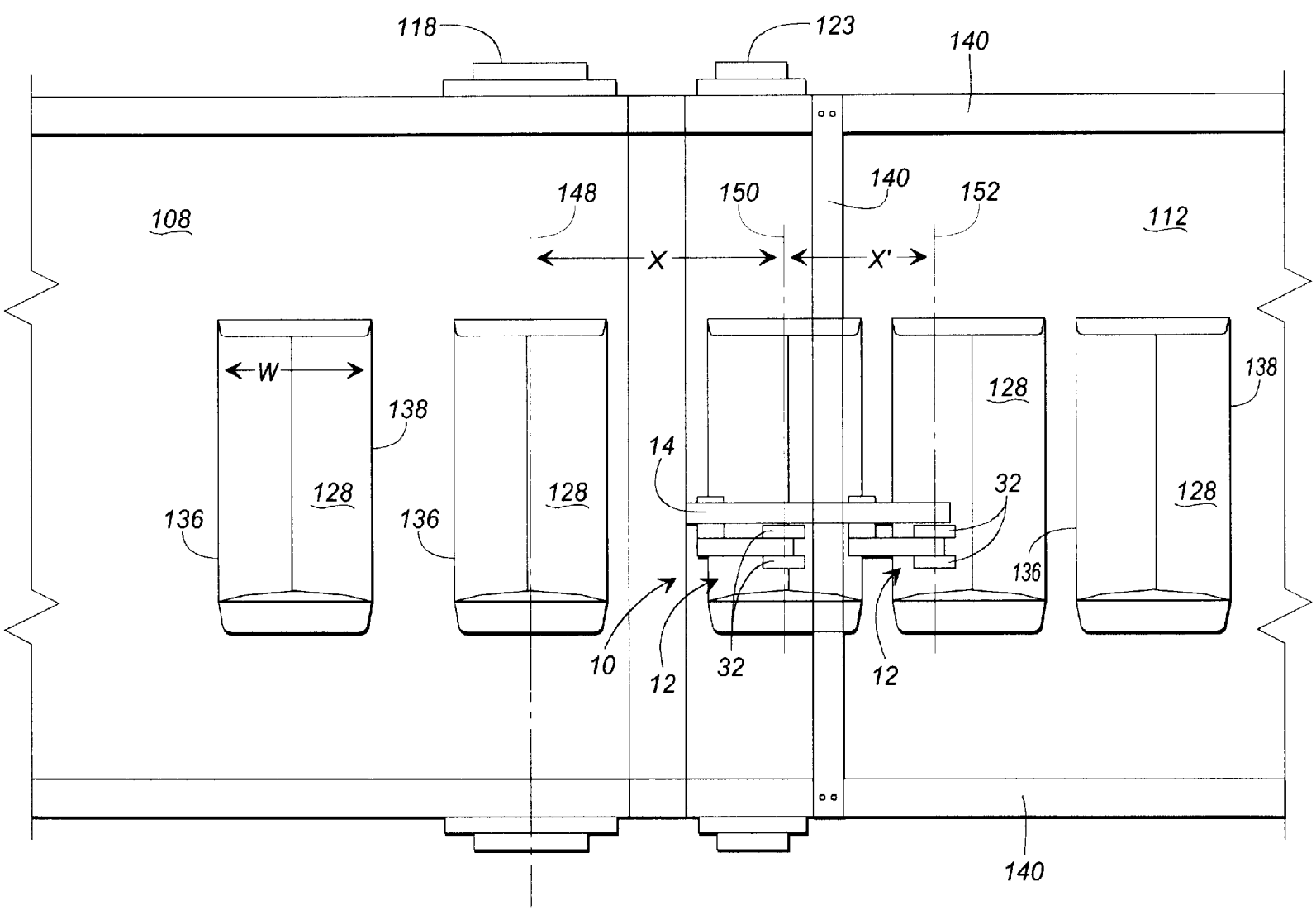
FIG. 7 illustrates a top view of representative envelopes being transported through the transfer area of FIG. 6 with the upper exit pulley and upper dryer belts not shown for clarity of description.

The adjustable control roller apparatus 10 of the present invention is capable of providing controlled and uniform transfer of work pieces, such as envelopes, from one conveyor section to another conveyor section, and is particularly well suited for use in controlling the transfer of work pieces from one conveyor section to a slower moving conveyor section. As shown in FIGS. 6 and 7, controlled transfer of work pieces is accomplished by positioning the rollers 32 of the apparatus 10 between the exit pulleys 118 and the entrance pulleys 122, such as by mounting the support bracket 12 to the support frame 140 in a conventional manner, i.e. clamping, fastening, etc., while allowing the rollers 32 to engage the lower dryer belt 112 at a position which corresponds to a position on each envelope residing between its top end 130 and bottom end 134 when it travels along the dryer belt 112. So mounted, the rollers 32 should engage a central portion of the envelope which has a substantially uniform thickness.

Vertical adjustment of the rollers 32 is accomplished by attaching a biasing member 40 (FIG. 4), such as a coil tension spring, elastic band, etc., between attachment members 34 and 38 of roller support leg 26 and upright support arm 13, thereby selectively controlling the downward control pressure exerted by the rollers 32 to the lower dryer belt 112, as well as the work pieces, i.e. envelopes 128, etc., transported thereon. The desired amount of pressure is determined by the dimensions of the work piece being transferred, the type conveyor section being utilized, etc., and should be determined on-site for a particular application. Additionally, horizontal adjustment of the rollers 32 is provided by the protrusion 18 which is slidably received within the slot 16. Once the horizontal placement of the rollers 32 is determined, the rollers 32 are substantially locked into position by tightening the screw lock 20, thereby securing the horizontal position of the upright support arm 12.

As shown in FIG. 7, a first work piece control assembly 12 is typically positioned so that the horizontal distance "X" between the longitudinal axis 148 of the exit pulleys 118 and the longitudinal axis 150 of the rollers 32 is minimized while still providing a long enough distance to allow the envelope 128 to depart the exit pulleys 118 prior to entering the rollers 32, therefore, the horizontal distance "X" is typically about 1/16" to 1/8" longer than the width "W" of the envelope 128 being transferred. Thus, the length of the slot 16 formed in the support bracket 14 typically corresponds to a range of roller positions which encompass the range of envelope widths to be processed by the particular conveyor assembly 100.

Additional control assemblies 12, as shown in FIG. 7 as a single additional control assembly 12, can be positioned within the slot 16 of the support bracket 14 after the first control assembly so that the additional control assembly 12 is positioned between the first control assembly 12 and the upper entrance pulley 122 (see FIG. 6) with the horizontal distance "X'" between the longitudinal axis 150 of the rollers 32 of the first control assembly and the longitudinal axis 152 of the rollers 32 of the additional control assembly is less than the width "W" of the envelope 128 being transferred. This configuration is intended to ensure that the alignment of the envelopes 128 is maintained by the multiple control assemblies 12 as the envelopes 128 transition into the dryer belts 110 and 112. It should be noted that any additional control assemblies 12 should be spaced from other assemblies so that the distance between adjacent roller longitudinal axes is also "X'".

Referring to FIGS. 6 and 7, it can be seen that a first envelope 128 traveling through a conveyor assembly 100 which incorporates an apparatus 10 of the present invention is carried between the belts 106 and 108 of the conveyor section 102 at a given speed. The envelope 128 ultimately passes between the exit pulleys 118 where the leading edge 138 of the envelope is directed toward the rollers 32 of the apparatus 10. Shortly after the trailing edge 136 of the envelope departs the belts 106 and 108, the leading edge 138 engages the roller 32 of the control assembly 12, thereby causing the envelope to engage the upper surface of the lower dryer belt 112. Since the belt 112 is operated at a slower speed than the belts 106 and 108, the envelope decelerates to match the speed of the lower dryer belt 112. The envelope 128 then advances through a second set of rollers 32, if included, and then travels below the upper dryer pulley 122 to enter the overlying portion of the upper and lower dryer belts 110 and 112 in a substantially aligned manner.

As described herein, the adjustable control roller apparatus 10 engages the intermediate central portions of the envelopes where the thickness of the envelopes are uniform, avoiding engagement with the tops and bottoms of the envelopes where the thickness of the envelopes are not uniform, and thereby, substantially prevents the envelopes from skewing relative to a conveyor belt when being transferred from one conveyor section to another. By utilizing the apparatus 10, envelopes are maintained in controlled alignment with the conveyor belts at all times, except during the short distance which the envelopes travel when leaving engagement of the belts of the gluing section and prior to engaging the control rollers of the present invention. This distance is approximately 1/16" to 1/8" and is formed by spacing the longitudinal axis of the exit pulleys of the gluing conveyor and the longitudinal axis of the first rollers of the apparatus 10 to a distance which equates to the width of the envelope to be transferred plus approximately 1/16" to 1/8". This 1/16" to 1/8" gap allows the envelope to disengage from the belts of the gluing section prior to engaging the control rollers of the present invention, thereby allowing the envelopes to change speed without causing the envelope to bend or buckle, or cause either conveyor to jam or otherwise malfunction.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated.

In particular, the present invention is equally well suited for use with work pieces of various types, including work pieces of various sizes, shapes, weights and surface textures. Additionally, the present invention is equally well suited for transferring a work piece from a slower moving conveyor section to a faster moving conveyor section, where a premature entrance of a work piece into the faster moving conveyor section can result in belt slippage or other malfunction of either conveyor section. All such modifications and variations, are within the scope of the invention as determined by the appended claims when interpreted in accordance with the breadth to which they are fairly and legally entitled.

Therefore, what is claimed is:

1. An adjustable control roller apparatus for use in a belt-type conveyor assembly for advancing flat work pieces of uniform width in sequence along a processing path the width oriented in the direction conveyance, the conveyor assembly having at least a first conveyor section and second conveyor section, the first conveyor section arranged to advance the work pieces in spaced sequence to said second conveyor section, the second conveyor section including a lower conveyor belt having an entrance end and an upper conveyor belt in overlying relationship with said lower conveyor belt and removed from the entrance end of said lower conveyor belt:

said adjustable control roller apparatus including an upright support arm having a pivot pin and a first attachment member;

a support leg engaging said pivot pin and having opposing first and second ends, a second attachment member mounted adjacent said first end, and a pair of rollers rotatably mounted adjacent said second end for positioning over the lower conveyor belt at the entrance end of the lower conveyor belt;

a biasing member engaging said first and second attachment members for biasing said rollers of said support leg toward the lower conveyor belt; and a support bracket for adjustably supporting said upright support arm such that said rollers can be positioned adjacent the first conveyor section at a distance greater than the width of the work pieces and adjacent the upper conveyor belt at a distance less than the width of the work pieces.

2. The adjustable control roller apparatus of claim 1, wherein said upright support arm has a locking member for engaging said support bracket such that said locking member selectively retains the position of said upright support arm relative to said support bracket.

3. The adjustable control roller apparatus of claim 1, wherein said biasing member is at least one coil tension spring.

4. The adjustable control roller apparatus of claim 1, wherein said support bracket has a slot extending therethrough for engaging said upright support arm.

5. The adjustable control roller apparatus of claim 4, wherein said upright support arm has a key member for engaging said slot.

6. The adjustable control roller apparatus of claim 5, wherein said key member has an internally threaded bore and said locking member has an externally threaded bolt for engaging said internally threaded bore.

7. An adjustable control roller apparatus for use in a belt-type conveyor assembly for processing work pieces, the work pieces having a uniform width, the width oriented in the direction of conveyance, the conveyor assembly having a support frame and at least a first conveyor section and a second conveyor section, the first conveyor section having exit pulleys, the exit pulleys each having a longitudinal axis, the second conveyor section including a lower conveyor belt, said apparatus comprising:

a first control assembly having a upright support arm, a support leg, and a biasing member;

said upright support arm pivotally engaging said support leg;

said support leg having at least one roller for engaging a lower conveyor belt of a second conveyor section, said roller having a longitudinal axis;

said biasing member engaging said upright support arm and said support leg for biasing said roller toward the lower conveyor belt of the second conveyor section;

the support bracket for mounting to a conveyor assembly support frame for adjustably supporting said first control assembly such that said roller can be positioned between the exit pulleys of a first conveyor section and an entrance pulley of a second conveyor section while said roller engages the lower conveyor belt of the second conveyor section with the distance between the longitudinal axis of the exit pulleys and the longitudinal axis of said roller being longer than the width of a work piece.

8. The adjustable control roller apparatus of claim 7, further comprising a second control assembly mounted to said support bracket, wherein said roller of said second control assembly.

9. A conveyor system for advancing folded paper envelopes along a processing path, with the envelopes each having a length and being of substantially of the same width and having a first end of one thickness and a second end of a second thickness that is different than the one thickness, and an intermediate portion between said ends of uniform thickness, said conveyor system comprising:

a first conveyor section for advancing the envelopes in spaced sequence along the processing path with the lengths of the envelopes extending across the processing path and having a discharge end for delivering the envelopes;

a second conveyor section positioned at said discharge end of said first conveyor section and arranged to receive envelopes from said first conveyor section, said second conveyor section including a lower conveyor belt having an upper flight with a receiving end positioned adjacent and in alignment with said first conveyor section for receiving envelopes thereon from said first conveyor section and an upper conveyor belt having a lower flight, said lower flight overlying said upper flight of said lower conveyor belt with a receiving end displaced farther from said discharge end of said first conveyor section than said receiving end of said upper flight of said lower conveyor belt;

at least one drive roller for driving said upper flight of said lower belt and said lower flight of said upper belt in the same direction;

a control roller apparatus positioned at the receiving end of said lower conveyor belt above said receiving end of said upper flight, comprising at least one roller in rolling engagement with said upper flight of said lower conveyor belt for engaging the intermediate portions of the envelopes after the envelopes are released by said first conveyor section and continuing to engage the envelopes until the envelopes are engaged by said upper conveyor belt;

said control roller apparatus including position adjustment means which adjusts the position of said control roller to place said control roller at a distance from said discharge end of said first conveyor greater than the width of the envelopes moving from said first conveyor section to said second conveyor section and to place said control roller at a distance from said upper conveyor belt a distance less than the width of the envelopes;

whereby envelopes are released from the first conveyor section onto the upper flight of the lower conveyor belt of the second conveyor section before the control roller engages the intermediate portions of the envelopes, the control roller engages the intermediate portions of the envelopes and maintains the envelopes in a constant angle with respect to the direction of conveyance on the upper flight of the lower conveyor belt until the lower flight of the upper conveyor belt engages the envelopes.

10. A conveyor assembly for advancing flat envelopes along a processing path, each envelope having a length normal to the direction of conveyance and the envelopes being of substantially uniform width, of different thickness at their opposed ends and of uniform thickness intermediate their opposed ends, said conveyor assembly including:

a first conveyor having a discharge end and means for advancing the envelopes in sequence along the processing path through said discharge end;

a second conveyor for receiving envelopes from said discharge end of said first conveyor, said second conveyor including upper and lower transport belts with overlying lower and upper flights, respectively, with said upper flight displaced farther than said lower flight from said discharge end of said first conveyor the improvement therein comprising:

a control roller assembly positioned adjacent said discharge end of said first conveyor belt over said upper flight of said lower transport belt, having an upright support arm, at least one roller movably mounted to said upright support arm for engaging said upper flight of said lower transport belt, and a biasing member engaging said upright support arm for biasing said roller toward said upper flight of said lower transport belt; and a support bracket engaging said upright support arm for adjustably supporting said control assembly such that said roller can be positioned at a distance greater than the width of an envelope from said first conveyor and at a distance less than the width of an envelope from said lower flight of said upper transport belt while said rollers engage the lower transport belt of the second conveyor.

* * * * *